US007086956B2

(12) United States Patent
Matthews

(10) Patent No.: US 7,086,956 B2
(45) Date of Patent: Aug. 8, 2006

(54) APPARATUS AND METHOD FOR RECORDING THE IMPACT LOCATION BETWEEN A GOLF BALL AND A GOLF CLUB

(76) Inventor: John P. Matthews, 5725 Old Middleton Rd, Madison, WI (US) 53705

( * ) Notice: Subject to any disclaimer, the term of this patent is extended or adjusted under 35 U.S.C. 154(b) by 0 days.

(21) Appl. No.: 10/966,368

(22) Filed: Oct. 16, 2004

(65) Prior Publication Data

US 2005/0233820 A1 Oct. 20, 2005

Related U.S. Application Data

(63) Continuation-in-part of application No. 10/313,415, filed on Dec. 6, 2002.

(51) Int. Cl.
*A63B 69/36* (2006.01)

(52) U.S. Cl. ..... 473/226; 473/237; 273/DIG. 30

(58) Field of Classification Search ..... 473/219, 473/235, 237, 226, 280; 273/DIG. 30
See application file for complete search history.

(56) References Cited

U.S. PATENT DOCUMENTS 2,660,436 A * 11/1953 Grossman ..... 473/237
3,273,891 A * 9/1966 Grim, Jr. ..... 473/240
3,401,941 A * 9/1968 Hesidence ..... 473/235
3,721,447 A * 3/1973 Louderback ..... 473/235
3,730,529 A * 5/1973 Donofrio ..... 473/237
3,754,764 A * 8/1973 Manheck ..... 473/237
3,806,132 A * 4/1974 Brandell ..... 473/237
3,870,316 A * 3/1975 DeBrocke ..... 473/235
4,149,726 A * 4/1979 Tredway, Sr. ..... 473/235
4,676,508 A * 6/1987 Dilny ..... 473/237
4,826,173 A * 5/1989 Brown ..... 473/235
4,875,689 A * 10/1989 Lin ..... 473/573
4,974,851 A * 12/1990 Closser et al. ..... 473/237
5,033,746 A * 7/1991 Jones ..... 473/237
5,121,924 A * 6/1992 Reed ..... 473/235
5,142,309 A * 8/1992 Lee ..... 473/237
5,181,723 A * 1/1993 Brown ..... 473/235
5,333,861 A * 8/1994 Mills ..... 473/329
5,342,052 A * 8/1994 Costa ..... 473/329
5,702,309 A * 12/1997 Lee ..... 473/235
5,779,556 A * 7/1998 Cervantes et al. ..... 473/237
5,807,196 A * 9/1998 Pompeo ..... 473/463
6,312,344 B1 * 11/2001 Smith ..... 473/237

* cited by examiner

*Primary Examiner*—Sebastiano Passaniti
(74) *Attorney, Agent, or Firm*—Joseph W. Byrne

(57) ABSTRACT

An apparatus and method for recording an impact location between a golf ball and a golf club is disclosed. The apparatus includes a recording member having a recording surface. The recording surface is disposed on one side of the recording member for recording the impact location between the golf ball and the golf club.

25 Claims, 8 Drawing Sheets

APPARATUS AND METHOD FOR RECORDING THE IMPACT LOCATION BETWEEN A GOLF BALL AND A GOLF CLUB

This application is a continuation-in-part application of prior U.S. patent application Ser. No. 10/313,415, filed Dec. 6, 2002.

FIELD OF THE INVENTION

The present invention relates generally to an apparatus and method for practicing the sport of golf. More specifically, it relates to an apparatus and method for recording the location of impact between a golf ball and the face of a golf club during a golf swing.

BACKGROUND OF THE INVENTION

Generally speaking, it can be said that each golf club has a "sweet spot" for striking a golf ball. The sweet spot is typically located at or near the center of the face of the golf club and defines the location on the face of the golf club where it is most desirable to make contact with the golf ball during the golf swing. Striking the golf ball at the sweet spot generally results in the best overall trajectory, distance and direction of flight for the golf ball.

It should be understood that golf club manufacturers do not identify the location of the sweet spot on the face of golf clubs. One reason for this is that the sweet spot for any given golfer may actually be located at a slightly different location on the face of the golf club. The exact location of the sweet spot for any given golfer is dependent in part on the characteristics of the golfer's swing, including the swing plane of the golfer's swing, as well as on the physical characteristics of the golfer.

A variety of factors contribute to the proper execution of a golf swing. These factors include the stance assumed by the golfer, the distance between the golfer and the golf balls the balance of weight assumed by the golfer, the golfer's grip on the golf club, the rotation of the golfer's shoulders and hips, and the speed and path of the back-swing, the down-swing and the follow-through swing. Each of these factors ultimately affects the manner in which the golf club makes contact with the golf ball, including the location of impact between the golf ball and the golf club. A properly executed golf swing will generally result in the golf ball impacting the face of the golf club at or near the sweet spot. The resultant forces imposed upon the golf ball by the golf club will then cause the golf ball to acheive the best overall trajectory, distance, and direction of flight.

Golfers typically perfect their golf swing by taking golf lessons or through practice and repeated trial and error. In order for these practice sessions to be of the greatest value to the golfer, it is desirable to provide the golfer with information and feedback concerning the golfer's swing each time the golfer takes a practice swing. One source of information that is easily obtained by the golfer relates to the trajectory, distance traveled and direction of flight of the golf ball. This information can be easily obtained by the golfer through simple observation of the golf ball after it leaves the face of the golf club. Thus, for each swing, the golfer can easily observe whether or not the swing produced the desired results.

One way for a golfer to identify the location of the sweet spot on the face of a golf club is to first observe the flight pattern (e.g., trajectory, distance traveled and direction of flight) of the golf ball for each golf swing to determine the results produced by each swing, and then second, observe the location of impact between the golf ball and the face of the golf club for each golf swing to determine which impact locations correspond to the best overall results. Providing the golfer with proper feedback regarding the location of impact between the golf ball and the face of the golf club, therefore, in combination with the golfer's own observation of the flight pattern of the golf ball, allows the golfer to identify the location of the sweet spot on the face of the golf club and further enables the golfer to adjust his or her stance, swing and/or grip to insure that the golf ball repeatedly strikes the face of the golf club at or near the sweet spot.

It is desirable, therefore, in addition to the information obtained by the golfer through his or her own observation of the flight pattern of the golf ball, to provide accurate feedback to the golfer regarding the location of impact between the golf ball and the face of the golf club so that the golfer can make the proper adjustments to his or her golf swing.

Numerous devices and systems for providing such feedback are known in the prior art as evidenced by U.S. Pat. No. 5,779,556 issued to Cervantes et al. on Jul. 14, 1998; U.S. Pat. No. 5,142,309 issued to Lee on Aug. 25, 1992; U.S. Pat. No. 5,033,746 issued to Jones on Jul. 23, 1991; U.S. Pat. No. 4,974,851 issued to Closser et al. on Dec. 4, 1990; U.S. Pat. No. 3,806,132 issued to Brandell on Apr. 23, 1974; U.S. Pat. No. 3,754,764 issued to Manheck on Aug. 28, 1973; and U.S. Pat. No. 2,660,436 issued to Gorssman on Nov. 24, 1953.

These known prior art systems suffer from one or more deficiencies, however. For example, many of these prior art systems are complex in that they are comprised of numerous layers of different materials. Some, for example, include wax or waxy layers that may, under force, slip or move out of position and whose properties may change in very warm or very cool weather. Others include one or more layers of paper or paper by-products that can easily tear during impact or be damaged by moisture or water. Finally, others include smooth outer plastic layers designed to protect the inner waxy or paper layers. The outer plastic layers tend to have relatively low coefficients of surface friction. The smooth plastic outer layers, therefore, may not accurately replicate the grip that the club face would have had on the ball in the absence of the recording device.

Another problem with these prior art devices relates to re-usability. Most of the prior art devices are designed to be used once, or at most, only a few times before they must be replaced. In all but one of these prior art systems, the mark or image left by the golf ball cannot be erased and repeated use of the recording device results in multiple marks being left on the recording device. The one prior art device that does provide for erasure of the mark left by the golf ball (see U.S. Pat. No. 5,033,746) suffers from the other drawbacks discussed above.

It is desirable, therefore, to have a recording device that is simple in construction yet rugged enough to handle the forces imparted by a golf ball during impact with a golf club. It is also desirable to have a recording device that can tolerate moisture and changes in temperature without effecting performance. It is also desirable to have a recording device that has a contact surface with a coefficient of surface friction that can accurately replicate the grip that a golf club puts on a golf ball. It is also desirable to have a recording device that can be used over and over again, both in terms of its lasting durability and in terms of its ability to provide for the erasure of earlier impact marks and images.

Another type of prior art practice device for identifying the impact location between a ball and the face of a golf club involves the use of hook and loop type fastening systems and lightweight practice golf balls. Two such prior art devices are disclosed in U.S. Pat. No. 3,721,447 which issued to Louderback on Mar. 20, 1973 and U.S. Pat. No. 3,401,941 which issued to Hesidence on Sep. 17, 1968.

As previously mentioned, each of these prior art devices use a hook and loop type fastening system (one type of which is commonly known as "Velcro") to identify the location of impact between a lightweight practice ball and the face of the golf club. In essence, one half of the hook and loop type fastener is applied to the face of the golf club and the other half is affixed to the practice ball. These devices work on the principle that upon impact between the practice ball and the face of the golf club, the practice ball will stick to the face of the golf club at the point of impact. Thus, the location of impact can be observed by simply viewing the stuck practice ball on the face of the golf club.

The prior art practice devices that incorporate a hook and loop type fastening system suffer from several major drawbacks, however. First, these prior art devices are not generally suited for use with real golf balls. Rather, they generally use lightweight practice golf balls such as lightweight hollow whiffe type golf balls. Regulation golf balls generally will not work with these prior art devices because they are too heavy and dense and simply will not remain stuck on the face of the golf club during and after the golf swing.

Second, a golfer using one of these prior art devices is not provided with any information regarding the trajectory, distance or direction of flight of the ball because the lightweight practice ball sticks to the face of the golf club. Without being able to observe what happened to the ball after it is hit, the golfer simply cannot evaluate the performance of his or her swing.

It is also desirable, therefore, to have a recording device suitable for use with real regulation golf balls. Preferably, the recording device will permit the golf ball to follow the same or substantially the same trajectory and direction of flight, and travel the same or substantially the same distance, as the golf ball would have traveled in the absence of the recording device. This will allow a golfer to obtain information regarding the end results produced by each golf swing in addition to providing the golfer with information regarding the impact location of the golf ball with the face of the golf club.

SUMMARY OF THE PRESENT INVENTION

According to a first aspect of the invention, an apparatus for recording an impact location between a golf ball and a golf club includes a recording member. An adhesive is disposed on one side of the recording member for affixing the recording member to the golf club. The opposite surface of the recording member is a napped surface for recording the impact location between the golf ball and the face of the golf club.

In one embodiment, the napped surface is a sueded surface. The recording member is selected from the group consisting of cowhide, calfskin, kidskin, lambskin, goatskin, pigskin, and deerskin in another embodiment and from the group consisting of velvet, velour and corduroy in one other embodiment. The napped surface includes a plurality of man-made fibers and a plurality of natural fibers in other embodiments. The adhesive material is a releasable adhesive in yet another embodiment and the recording member includes an aperture in one other embodiment.

According to a second aspect of the present invention, an apparatus for recording an impact location between a golf ball and a golf club includes a recording member. An adhesive is disposed on a first surface of the recording member for attaching the recording member to the face of the golf club. A plurality of fibers are disposed on the opposite surface of the recording member for recording the impact location between the golf ball and the golf club.

The plurality of fibers are natural fibers in one embodiment and are hairs in another embodiment. The plurality of fibers are man-made in yet another embodiment of the present invention. The adhesive is double-sided tape in one other embodiment.

According to a third aspect of the invention, a method of recording a location of impact between a golf ball and a golf club includes attaching a recording member having a napped surface to the golf club, striking the golf ball with the golf club, and leaving a mark on the napped surface at the location of impact between the golf ball and the golf club.

The mark is created by compressing the napped surface at the location of impact between the golf ball and the golf club in one embodiment. In another embodiment, the napped surface includes a plurality of fibers and the mark is created by mis-aligning the plurality of fibers at the location of impact between the golf ball and the golf club. In one other embodiment, the method includes erasing the mark from the napped surface. The mark is erased by raising the napped surface in one embodiment and by brushing the napped surface in another embodiment.

According to a fourth aspect of the invention, an apparatus for recording an impact location between a golf ball and a face of a golf club includes a recording member sized-to-fit on the face of the golf club. The recording member has a napped surface for recording the impact location of the golf ball with the face of the golf club.

The recording member includes an adhesive for attaching the recording member to the face of the golf club in one embodiment. In another embodiment, the recording member is selected from the group consisting of cowhide, calfskin, kidskin, lambskin, goatskin, pigskin, and deerskin. In yet another embodiment, the recording member is selected from the group consisting of velvet, velour and corduroy. The napped surface includes a plurality of man-made fibers and a plurality of natural fibers in two other embodiments of the present invention.

Other principal features and advantages of the invention will become apparent to those skilled in the art upon review of the following drawings, the detailed description and the appended claims.

BRIEF DESCRIPTION OF THE DRAWINGS

The drawings, which constitute a part of the specification, are as follows.

Figure 1:
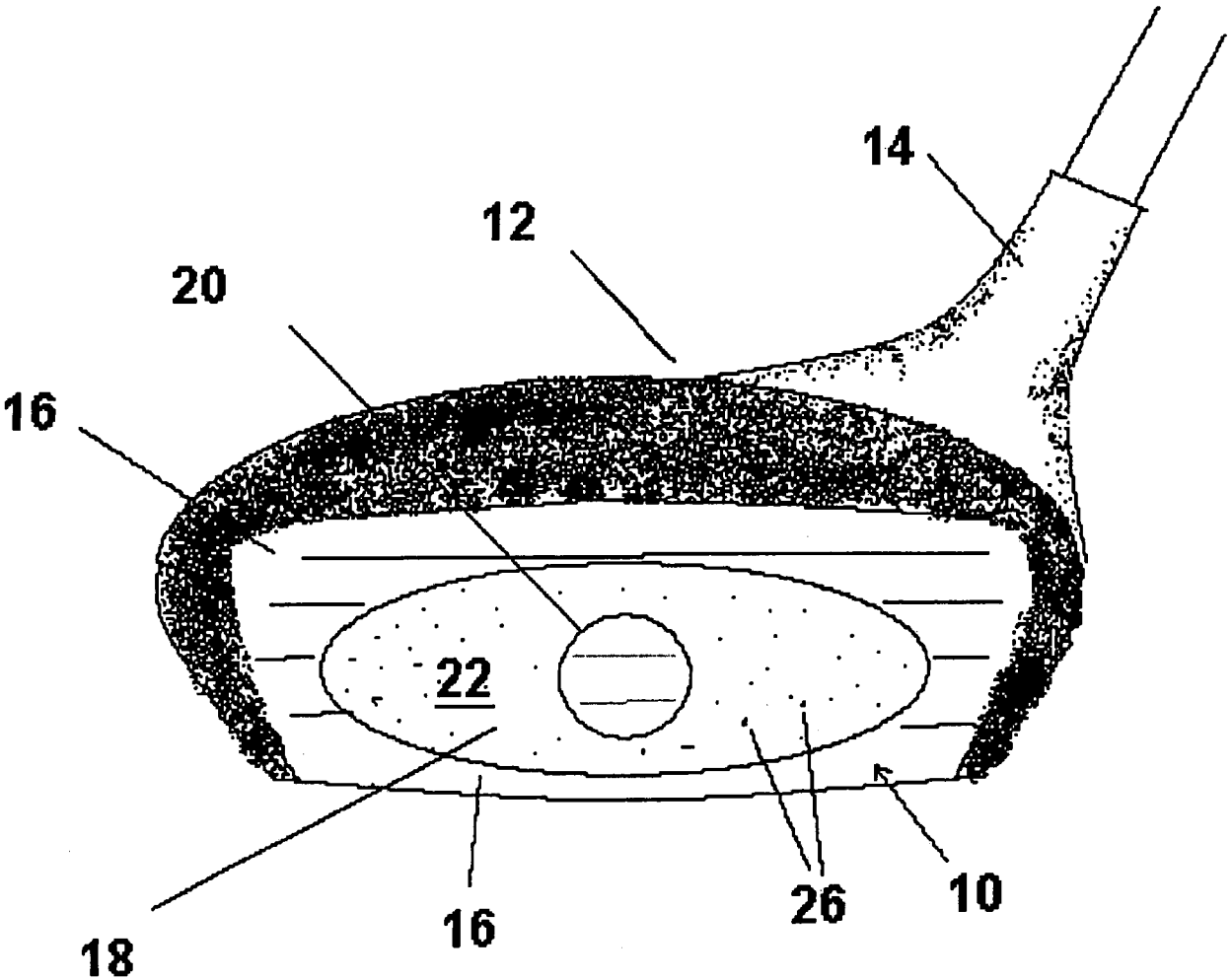
FIG. 1 is a front view of a recording device according to one embodiment of the present invention, as attached to the head of a golf club.

Before explaining at least one embodiment of the present invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular golf ball impact recording apparatus and method having a particular configuration and particular features, the present invention is not limited to this configuration or to these features and other configurations and other features can be used. Also, although the present invention will be illustrated with reference to the sport of golf, the present invention is not limited to the sport of golf and may have application in other sports and in other activities as well.

Generally, the present invention involves an apparatus and method for recording the location of the point of impact between a golf ball and a golf club during a golf swing. The recording device can be used with real regulation golf balls and upon impact with the golf ball, the golf ball follows a trajectory, travels a distance, and assumes a direction of flight that is the same as, or substantially the same as, the trajectory, distance, and direction of flight that the golf ball would have taken if hit directly by the face of the golf club. In other words, the recording device does not substantially effect the trajectory, distance, and/or direction of flight of the golf ball, but rather allows the golf ball to behave in substantially the same manner as golf balls hit directly by the face of golf club. This allows the golfer to obtain valuable feedback in that it allows the golfer to assess the quality of his or her golf shot for any given impact location and swing when using a recording device according to the present invention.

The phrases "substantially the same as," "substantially does not effect," and other like phrases, as used herein in relation to the trajectory, distance and direction of flight of a golf ball, mean that a golfer generally will not perceive or notice a difference in these flight parameters as a result of the golf ball striking the recording device instead of the golf club itself.

According to one embodiment, the recording device includes a recording member having a recording or impact surface on its front face capable of recording the impact location between the golf ball and the face of the golf club. The recording surface is a napped or piled surface in this embodiment and is comprised of a plurality of hairs or fibers on the front side of the recording device. An adhesive material is included with, or applied to, the back side of the recording device. The recording device is sized-to-fit (e.g., dimensioned to fit) on the face of the golf club and is attached to the golf club face using the adhesive material.

The recording member is a leather recording member or patch made from brahma cowhide in one embodiment. The napped surface is a sueded surface in this embodiment. In other embodiments, the recording member is made from other types of natural or man-made materials, including man-made sueded materials. The end result is that recording devices made from these types of materials are extremely durable and can survive scores of impacts without tearing or damage. Furthermore, the napped surface of these recording devices tend to have a higher coefficient of surface friction than is exhibited by known prior art recording devices. Thus, recording devices in accordance with certain embodiments of the present invention will more accurately replicate the grip imposed upon a real regulation golf ball by the golf club than do the known prior art devices.

Prior to impact with the golf ball, the hairs or fibers on the recording surface of the recording member are generally all or substantially all raised and oriented in the same or substantially the same general direction. Upon impact with the golf ball during the golf swing, the hairs or fibers at the location of impact are immediately compressed and become disoriented or misaligned with respect to each other. This compression is due to the large force exerted on the recording surface by the impacting golf ball. The compression and/or misalignment of the fibers at the point of impact changes the texture of the napped recording surface at that point. The change in texture leaves a distinct and visible mark or impression (in some cases, an actual image of the golf ball showing the dimples of the golf ball is left) recorded on the recording device (e.g., on the napped recording surface) at the location of impact. Thus, by simply viewing the recording surface of the recording member after impact, the location at which the golf ball impacted the face of the golf club can be easily determined.

The recording surface of the recording member tends to retain its character after impact and thus the recorded mark left by the golf ball at the impact location will generally remain on the recording surface until it is removed or erased by the golfer. Removal of the mark is accomplished in one embodiment of the present invention by simply brushing the napped recording surface of the recording member to raise the nap at the location of impact. The brushing action raises the nap to its original pre-impact condition and the mark is thereby erased. The recording member is now ready for re-use.

Because the recording device is durable and erasable, it can be used repeatedly. For example, the recording device can be used over and over again during any single practice session simply by erasing the earlier marks that appear on the napped recording surface. Furthermore, because of its durability, the recording device of the present invention can be removed from the face of one golf club and affixed to the face of another golf club or it can be stored for use on another day.

Referring initially to FIG. 1, a recording device 10 according to one embodiment of the present invention is shown attached to a golf club head 12 of a golf club 14. More specifically, recording device 10 is shown attached to the face 16 of golf club head 12. Although the particular golf club shown in FIG. 1 is a "wood" (also called a "driver"), the use of a wood in the figures is for illustrative purposes only. It should be understood that the recording device of the present invention can be used with other types of golf clubs having other shapes and sizes, including irons, wedges and putters.

Recording device 10 is oval in shape in the embodiment of FIG. 1 and is sized-to-fit on face 16 of golf club 14. Sized-to-fit, as used herein, means that the recording member is sized-to-fit on the face of a golf club. In other words, the dimensions of the recording member are such that the recording device will fit on the face of a golf club. It should be noted that the present invention is not limited to this particular size and other sizes of recording devices could be used. In other embodiments, for example, the recording member covers more or less of the face of the golf club than does the recording device shown in FIG. 1.

It should also be noted that the present invention is not limited to the particular oval shape shown in FIG. 1 and other shapes could be used including circular, square, rectangular, trapezoidal, or even irregular shapes. In other embodiments of the present invention, for example, the recording member has the same shape (or substantially the same shape) as the face of the golf club.

Recording device 10 is comprised of a recording member 18 having a central aperture 20 in this embodiment. Aperture 20 is positioned in FIG. 1 at the approximate location of the sweet spot of golf club 14. Central aperture 20 is included in this embodiment to allow the golf ball to directly contact the sweet spot on the face of the golf club without any interference from the recording device. In this embodiment, the diameter of aperture 20 is approximately 0.8 inches. In other embodiments, aperture 20 is larger or smaller than 0.8 inches and may be positioned at a location other than the sweet spot. It should be noted that the inclusion of an aperture on recording device 10 is not required and in other embodiments of the present invention, no aperture is provided or more than one aperture is provided.

Figure 4:
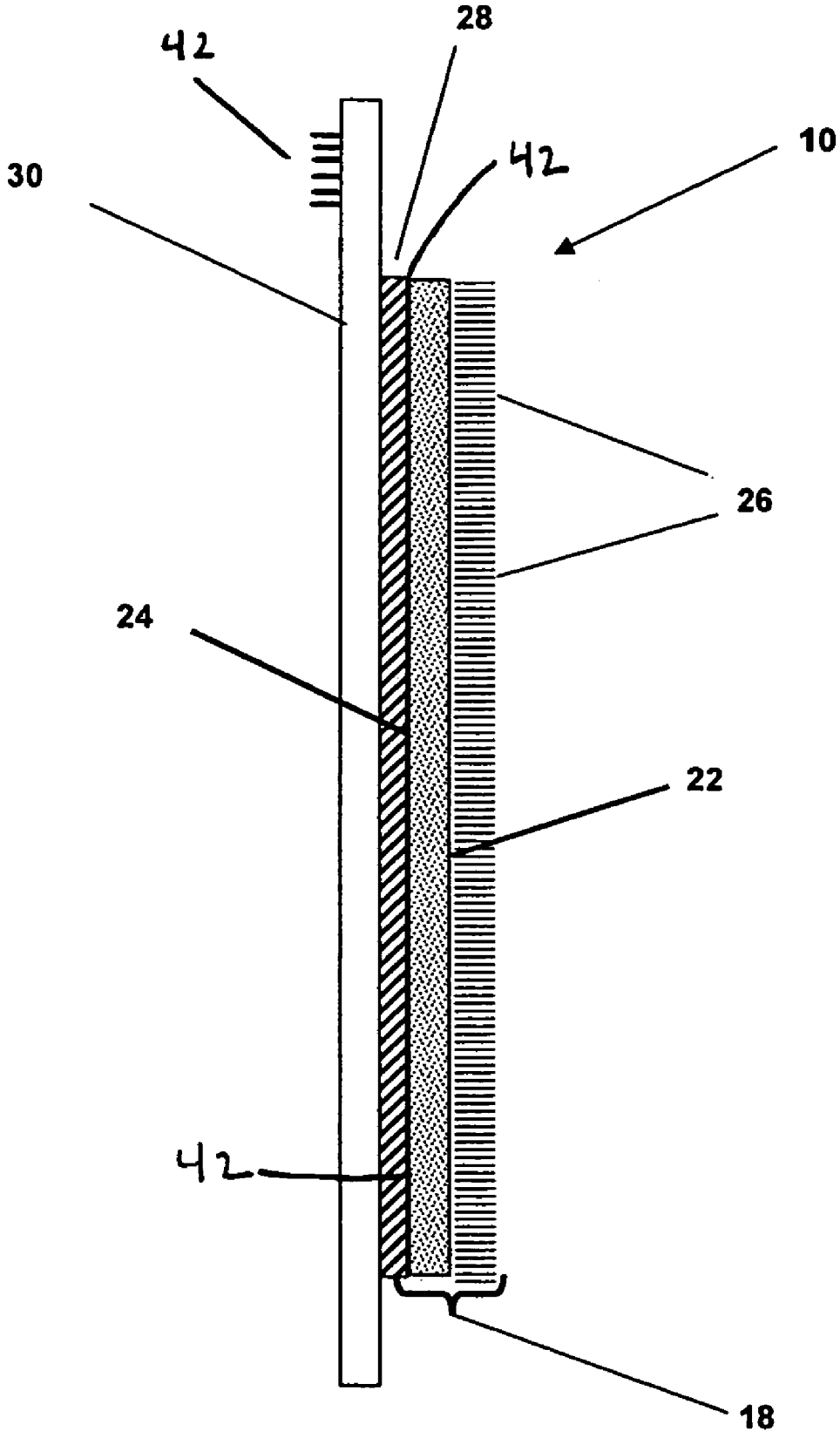
FIG. 4 is a cross-sectional side view of the recording device of FIG. 1.

As shown in FIG. 4, recording member 18 includes front and back opposing sides or surfaces 22, 24 respectively. The front surface 22 of recording member 18 is a napped or piled surface comprised of a plurality of hairs or fibers 26. Nap or napped surface as used herein means a hairy or downy surface. Pile or piled surface, as used herein means a surface of usually short, close, fine furry hairs or fibers. Hair as used herein means a slender threadlike outgrowth and includes both natural and man-made hairs and hair-like structures. Fiber, as used herein, means a thread or a structure or object resembling a thread and includes both natural and man-made fibers.

It should be understood that the hook and loop surfaces of a hook and loop type fastening system such as "Velcro" are not napped or piled surfaces as those terms are used herein. It should also be noted that the relative dimensions of the various layers depicted in FIG. 4 (and in FIGS. 6 and 7) are not to scale, but are rather for illustrative purposes only.

Recording member 18 is a leather recording member and is made from one (1) ounce leather having a thickness of 0.4 millimeters (or 0.015625 inches) or approximately 0.4 millimeters (or 0.015625 inches) in one embodiment. In other embodiments of the present invention, however, other weights of leather are used for recording member 18 including one and one-half (1.5) ounce leather having a thickness or approximate thickness of 0.6 millimeters (or 0.023438 inches) and two (2) ounce leather having a thickness or approximate thickness of 0.8 millimeters (or 0.03125 inches). The present invention is not limited to recording devices made from the particular leather weights and thicknesses stated in this paragraph and other weights and thicknesses can be used.

It should be noted, however, that leather recording members having a thickness in the range of 0.4 millimeters (or 0.015625 inches) to 0.9 millimeters (or 0.035433 inches) are preferred because they provide the most desirable overall performance. This is because leather recording members having a thickness of less than 0.4 millimeters generally do not provide the desired durability necessary for an extended life of continued use and re-use. On the other end of the preferred range, leather recording members having a thickness that is greater than 0.9 millimeters have the potential to negatively impact the trajectory, distance and direction of flight of the golf ball. For example, leather recording members having a thickness greater than 0.9 millimeters have a tendency to dampen the impact between the golf ball and the face of the golf club thus resulting in less distance.

In addition, leather recording members having a thickness of greater than 0.9 millimeters also have the potential to affect the trajectory and direction of flight of the golf ball. This can result, for example, when the golf ball impacts the recording member along the edge of the aperture such that the golf ball partially impacts the recording member and partially impacts the face of the golf club. In these cases, the step formed between the recording surface and the face of the golf club (e.g., equal to the thickness of the recording member) can effect the trajectory and direction of flight if the thickness of the recording member is greater than 0.9 millimeters.

The back side 24 of recording member 18 includes a layer of adhesive material 28 in the embodiment shown in FIG. 4. The adhesive material in this embodiment is a releasable adhesive material such as is used with removable labels. Adhesive material 28 is used to affix recording device 10 to the face of golf club 14.

A barrier layer 42 is applied to the back side 24 of recording member 18 in one embodiment. This barrier layer is disposed between recording member 18 and adhesive layer 28 to impede or inhibit oils present in leather recording member 18 from migrating or flowing into adhesive layer 28. These oils, which are added to the finished leather to make the leather soft and pliable, can have an adverse effect on both the adhesive layer's ability to adhere to the recording member as well as the adhesive layer's ability to adhere to the face of the golf club.

In one embodiment, barrier layer 42 is a coating of polyurethane resin that is applied to the back side 24 of recording member 18 prior to the application or affixation of adhesive layer 28. In another embodiment, a coating of nitro cellulose lacquer is applied to the back side 24 of recording member 24 to form barrier layer 42.

It should be understood that the two materials identified above for barrier layer 42 are provided for illustrative purposes only and should not be construed as the only materials that can be used for barrier layer 42. In other embodiments of the present invention, other materials are used for barrier layer 42. In yet other embodiments, no barrier layer is required or provided. As used herein, the term barrier layer means any layer of material that is applied to the back side of a recording member to impede or inhibit the migration or flow of oil from the recording member through to the adhesive layer.

The oil content on the weight of the finished leather used to make recording member 18 in one embodiment of the present invention is in the range of eight (8) percent to twelve (12) percent inclusive. For example, in one embodiment, the oil content of leather recording member 18 is ten (10) percent on the weight of the leather. In other embodiments, the oil content is eight (8) percent or twelve (12)

percent on the weight of the leather or approximately eight (8) percent or twelve (12) percent.

It should be noted that the present invention is not necessarily limited to leathers having the particular oil contents specified above and finished leathers having other oil contents can be used as well. However, it has been found that leather recording members having an oil content of less than eight (8) percent do not exhibit the desired pliability to allow for a long life of repeated use and re-use of the recording device. Finished leathers having an oil content of greater than twelve (12) percent, on the other hand, are more likely to have oil leach or migrate out of the recording member and into the adhesive layer.

It should be understood that the term "in the range," as used herein throughout, means a range that is inclusive of the end points of the range.

In one embodiment, recording member 18 is treated by chemical or other means to increase its water or moisture repellence. In other embodiments, no such treatments are provided.

When not in use, recording device 10 is stored attached to a carrier or backing material 30, such as paper or plastic, to prevent the adhesive layer 28 of recording device 10 from adhering to unintended objects. Carrier 30 is of such a nature that recording device 10 can be easily removed from carrier 30 without damaging adhesive layer 28.

In one embodiment, for example, carrier 30 is made of plastic and is similar in size, shape and thickness to a credit card. This allows recording device 10 to be easily carried inside of a golfer's wallet or purse. Recording member 18 is releasably affixed to the front side of carrier 30 and instructions for using recording device 10 are printed on the back side of the credit card sized carrier 30.

For example, in one embodiment of the present invention, the length and width of carrier card 30 is 2.175 inches (55.245 millimeters) and 3.375 inches (85.725 millimeters) respectively and the thickness of carrier member 30 is 0.03 inches (0.0762 millimeters). These are the dimensions of a standard credit card as specified by the ISO 7180 standard. In other embodiments, carrier card 30 has approximately or substantially these same dimensions.

It should be noted that carrier 30 is not limited to being credit card sized and other sizes of backing carriers can be used. Likewise, more than one recording member 18 can be mounted to a single carrier. In other embodiments, for example, carrier 30 is a sheet of material and two, four or eight recording members are mounted on a single backing carrier 30.

In another embodiment, carrier 30 includes a first section and a second section. The two sections are separated by a perforated or creased line or some other mechanism that allows the two sections to be easily separated by hand through a tearing or bending operation. The first section (typically the upper section) includes a hole or opening for mounting the carrier on a peg for display at a retail store. The first section may also include instructions for using the recording device and/or it may be imprinted with the manufacturer's name and/or logo or with a customer's name and/or logo. The second section (typically the lower section), which may or may not be credit card sized, has one or more recording device attached to it. The first section is separated from the second section after purchase. This allows the second section containing the recording device to be stored in a purse or wallet.

In yet another embodiment, a brushing device or brushing member 42 is mounted on the back side of carrier 30 for use in erasing the visible impact mark left by the golf ball on napped surface 22. For example, brushing member 42 is the "hook" half of a hook and loop type fastener, one type of which is commonly known as "Velcro" in one embodiment. Brushing member 42 includes an adhesive backing material and is affixed to one corner of carrier 30 in this embodiment. In other embodiments, no brushing member is provided on carrier 30 or the brushing member is mounted at a different location on carrier 30 such as on the front side of carrier card 30.

Napped or piled recording surface 22 of recording member 18 exhibits several useful properties or characteristics that enable recording device 10 to record the impact location of a golf ball with a golf club in this embodiment. Normally, the hairs or fibers that form the nap or pile on surface 22 are raised such that all or substantially all of the hairs or fibers are standing upright or substantially upright (uncompressed and un-matted) and/or are generally uniform and aligned or oriented in the same or substantially the same direction.

Now, when an object touches or impacts raised napped or piled surface 22, the hairs or fibers 26 at the location of impact are compressed or matted down by the large force exerted by the golf ball and are no longer aligned or oriented with each other. The texture and light reflecting properties of the material at the location of impact is changed such that a visible mark or impression (or in some cases, an actual image of the golf ball including an image of the dimples of the golf ball) is recorded on the napped surface at the location of impact.

It should be noted that ball marks will generally be perceivable (e.g., visible) on the napped recording surface of the present invention when the height, texture and/or general directional orientation of the hairs, fibers or strands that make up the napped surface at the location of impact differ from the height, texture and/or general directional orientation of the hairs, fibers or strands located on the balance or remainder of the napped surface. Anyone who has drawn his or her finger across the surface of a suede jacket, for instance, has seen this same type of effect in the nature of a line left on the jacket's surface. Similarly, anyone who has walked across freshly vacuumed carpet has seen this effect in the nature of the footprints that are left behind on the surface of the freshly vacuumed carpet.

Another useful property of some, but not all, napped or piled surfaces is that the image left by touching or impacting the napped or piled surface tends to remain on the surface until erased. In other words, the surface has memory. The image or mark left on the surface can generally be removed only by raising the nap or pile at the location of the touch or impact (e.g., the mark is erasibly recorded in the napped or piled surface). Thus, a mark or image left on the napped or piled surface of recording member 18 is generally visible until it is erased or removed.

The mark on recording member 18 can be erased simply by brushing, stroking, sweeping or abrading the napped or piled surface to once again raise the nap at the location of impact. It should be noted, however, that different napped or piled materials exhibit different properties with respect to how long a mark will last and in some cases, the pile or nap may return to its raised condition on its own without the need for brushing, sweeping, or stroking of the napped or piled surface.

The terms record and recorded, as used herein, mean that upon impact with a golf ball, a mark or impression (or other indicia of the point of impact) is visible in the recording surface of the recording device and the mark or impression (or other indicia) remains visible in the recording surface until it is physically erased from the recording surface by the golfer.

Various materials have napped or piled surfaces that exhibit the properties and characteristics described above and can therefore be used for recording member 18. In one embodiment of the present invention, for instance, the napped surface 22 is a sueded surface (leather with a napped surface) formed from animal hides. Various types of animal skins and hides can be used to obtain a sueded or napped surface including, without limitation, cowhide, split cowhide, calfskin, kidskin, lambskin, goatskin, pigskin, and deerskin. The sueded or napped surface is typically produced by buffing the flesh side of the hide or skin to raise a velvet-like nap on the surface. The sueded surface may also be produced on the grain side (the outside surface) of the hide or skin, however this is less common.

In addition to natural animal hides, the napped surface 22 of recording member 18 can also be formed from man-made materials. For instance, many man-made suede-like materials are available that replicate the look and feel of suede. These materials are known by various names including "suede cloth," "faux suede," "Ultra Suede.," Every-day Suede," "Microfiber Suede," and "Jasper Suede." These man-made suede-like materials are generally made from 100% polyester or nylon/polyester blended yarn that is spun into micro fiber-like fabric. The fabric is brushed with pins or wires to raised the nap and achieve a suede-like touch or feel to the hand. Finally, the fabric is sheared to give it a suede-like look and texture.

In addition to the man-made suede-like materials discussed above, the napped surface 22 of recording device 10 can also be formed from other man-made materials including other textile and fabric materials, such as velvet, velour, and corduroy for instance. In general, it should be understood that the recording member 18 is not limited to being made from the natural or man-made materials discussed above. Those materials are listed here for illustrative purposes only. The napped and piled surfaces of the present invention can be formed from any material, natural or man-made, that includes a napped or piled surface that can record a mark or an image by matting or compressing the hairs, fibers or strands that form the napped or piled surface.

The back surface 24 of recording member 18 is configured for attachment to the face of a golf club (see FIG. 4). In one embodiment, for example, an adhesive material, such as a releasable or repositionable adhesive 28, is disposed on back surface 24 of recording member 18. The releasable adhesive is provided to secure recording device 10 to face 16 of golf club 14. Using a releasable or repositionable adhesive allows recording member 10 to remain fixed in place on face 16 during usage and still allows for recording member 10 to be easily removed from face 16 after usage without leaving any adhesive residue behind on face 16.

A portion of the back side 24 of recording member 18 does not include adhesive in one embodiment. This portion is left without adhesive material to facilitate easy removal of the recording device from the face of golf club 14. For instance, the entire outer perimeter of the back side 24 of recording member 18 does not include any adhesive in one embodiment. In another embodiment, one end of the back side 24 of recording member 18 does not include adhesive.

Figure 8:
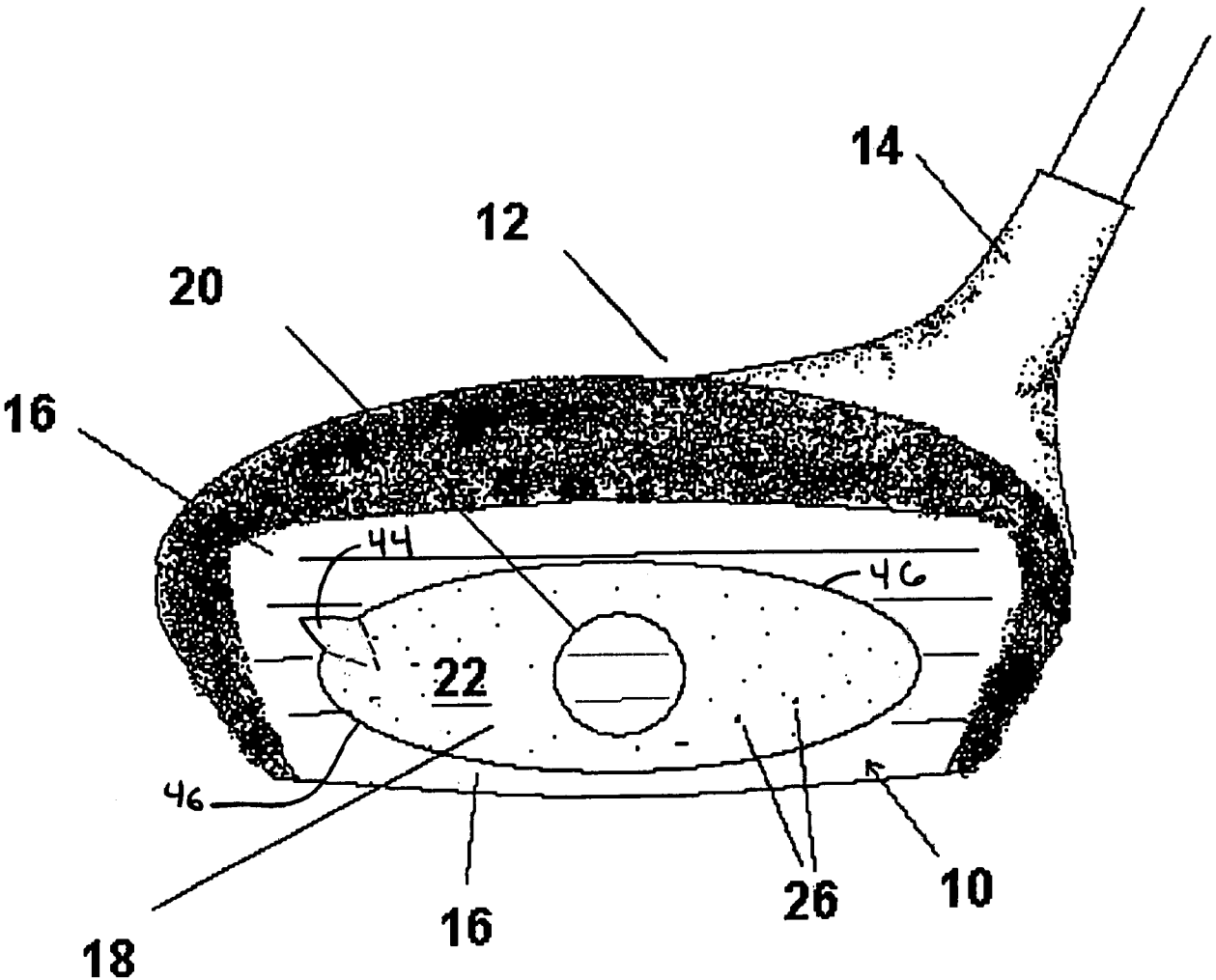
FIG. 8 is a front view of a recording device according to a fourth embodiment of the present invention, as attached to the head of a golf club.

In yet another embodiment of the present invention, the entire back side 24 of recording member 18 is covered by an adhesive. To facilitate removal, recording member 18 includes a small ear or wing 44 that extends outward from the outer edge 46 of the recording member (see FIG. 8). The adhesive layer 24 is applied to the back side of ear 44 in the same manner as it is applied to the back side of the remainder of recording member 18. Ear 44 folds under recording member 18 and is held in place because the adhesive layer on its backside adheres to the adhesive layer on the back side of recording member 18. Once folded under, ear 44 provides a tab on the back side of recording member 18 for facilitating the removal of recording device 10 from carrier card 30 and the face of the golf club.

Releasable adhesives of the type discussed above are well known and can take the form of the tacky material used with known removable labels or can take the form of a double-sided tape for instance. For example, in one embodiment, a double-sided differential coated high tack/low tack tape is used as the adhesive layer. The tape includes a one (1) mil clear polyester film having a high tack permanent acrylic adhesive on the exposed side and a low tack removable adhesive on the liner side. The differential adhesive ratio between sides is approximately 5:1. Other physical properties of this particular double-sided tape include a tape thickness of 3.75 mils, a liner thickness of 3.5 mils, a peel adhesion using the PSTC-3 test methodology of 80 ounces/inch width for the exposed side and 16 ounces/inch width for the liner side, elongation of 100%, and tensile strength of 16 lbs/inch width. This double-sided tape also has a paper release liner configuration.

Other types and forms of releasable, repositionable, and permanent adhesives are used in other embodiments. Adhesive or adhesive material, as those terms are used herein, include all types of adhesives including glues, tapes, etc. . . .

In an alternative embodiment of the present invention, no adhesive is provided on the back side 24 of recording member 18. Rather, the back side is configured to receive an adhesive and the adhesive is actually applied by the golfer just prior to mounting of the recording member on the face of the golf club.

Figure 5:
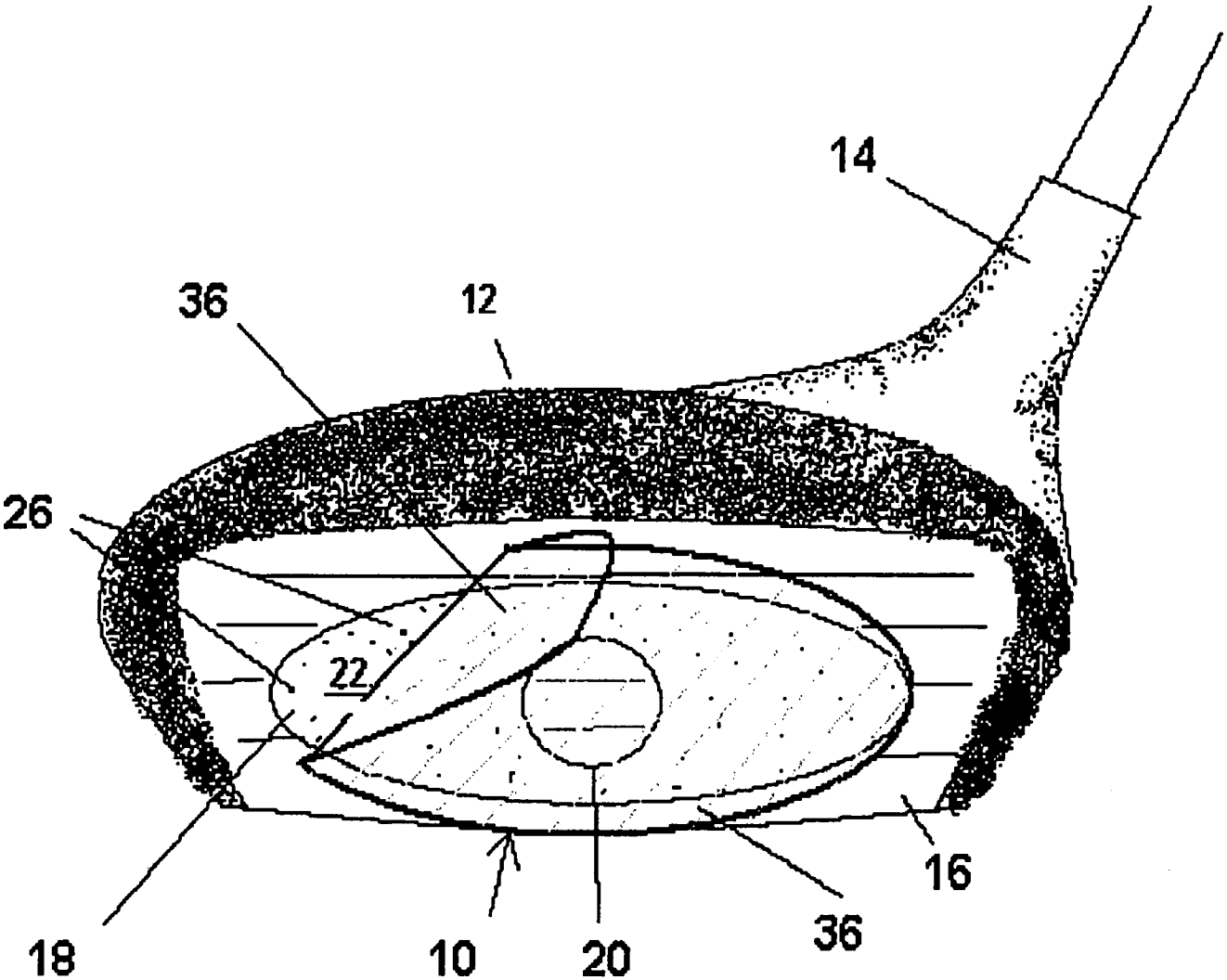
FIG. 5 is a front view of a recording device having a protective layer covering the recording device according to a second embodiment of the present invention.
Figure 6:
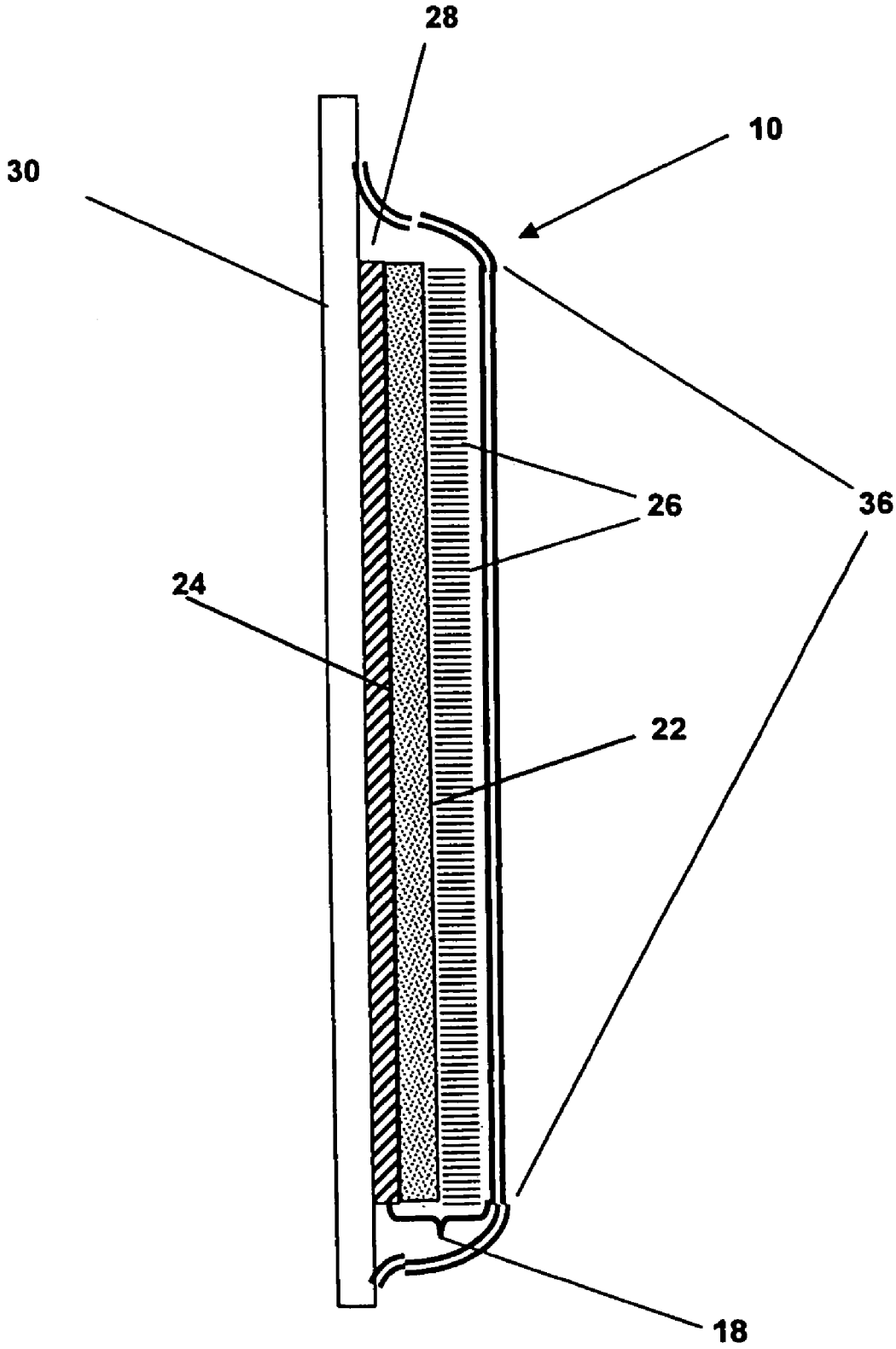
FIG. 6 is a cross-sectional side view of the recording device of FIG. 5.

Another alternative embodiment of the present invention shown in FIGS. 5 and 6 includes a protective layer of transparent or translucent material 36 positioned over the napped surface 22 of recording member 18. The protective layer 36 is used in this embodiment to protect recording member 18 and napped surface 22 from the potential deleterious effects of moisture, sand, dirt or other debris that may be present during a golf swing. In this way, the napped recording surface 22 of recording member 18 remains unsoiled.

The protective layer 36 in this embodiment is attached to the recording member using a releasable adhesive (not shown). Protective layer 36 can be easily removed, therefore, to allow napped surface 22 to be inspected and brushed after each use. The protective layer 36 is then replaced over napped surface 22 prior to re-use of recording device 10.

Figure 7:
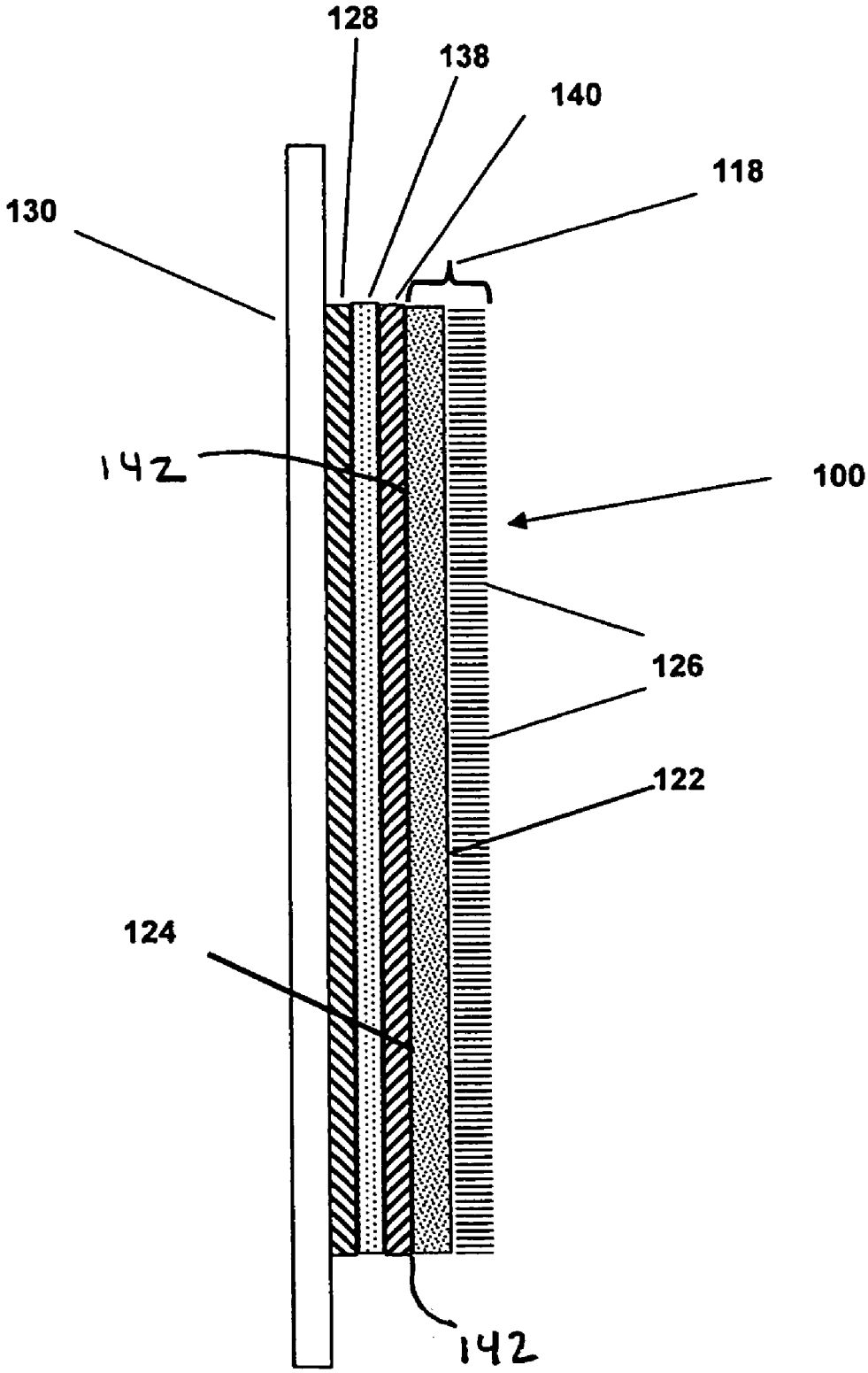
FIG. 7 is a cross-sectional side view of the recording device according to a third embodiment of the present invention.

In yet another embodiment of the present invention shown in FIG. 7, a recording device 100 includes a recording member 118. The front side of recording member 118 includes a napped or piled surface 122 having a plurality of hairs or fibers 126. A permanent adhesive material or layer 140 is applied to the back side 124 of recording member 118. If recording member 118 includes oils, then a barrier layer 142 may be provided between recording member 118 and permanent adhesive layer 140 to inhibit the migration or flow of oil from leather recording member 118 to adhesive layer 140.

The front side of a carrier member 138 is then attached to the back side 124 of recording member 118 using permanent adhesive 140. A releasable adhesive layer 128 is attached or applied to the back side of carrier member 138 for use in attaching recording device 100 to the face of a golf club. In this embodiment, therefore, the releasable adhesive is not applied directly to back side 124 of recording member 118, but rather is applied to carrier member 138. This configuration may be desirable, for instance, if back side 124 of recording member 118 is not suitable for the application of a releasable adhesive.

When not in use, recording device 100 of FIG. 7 is stored attached to a backing material 130 to prevent the releasable adhesive layer 128 from adhering to unintended objects. Backing material 130 is of such a nature that recording device 100 can be easily removed from backing material 130 without damaging adhesive layer 128.

Figure 2:
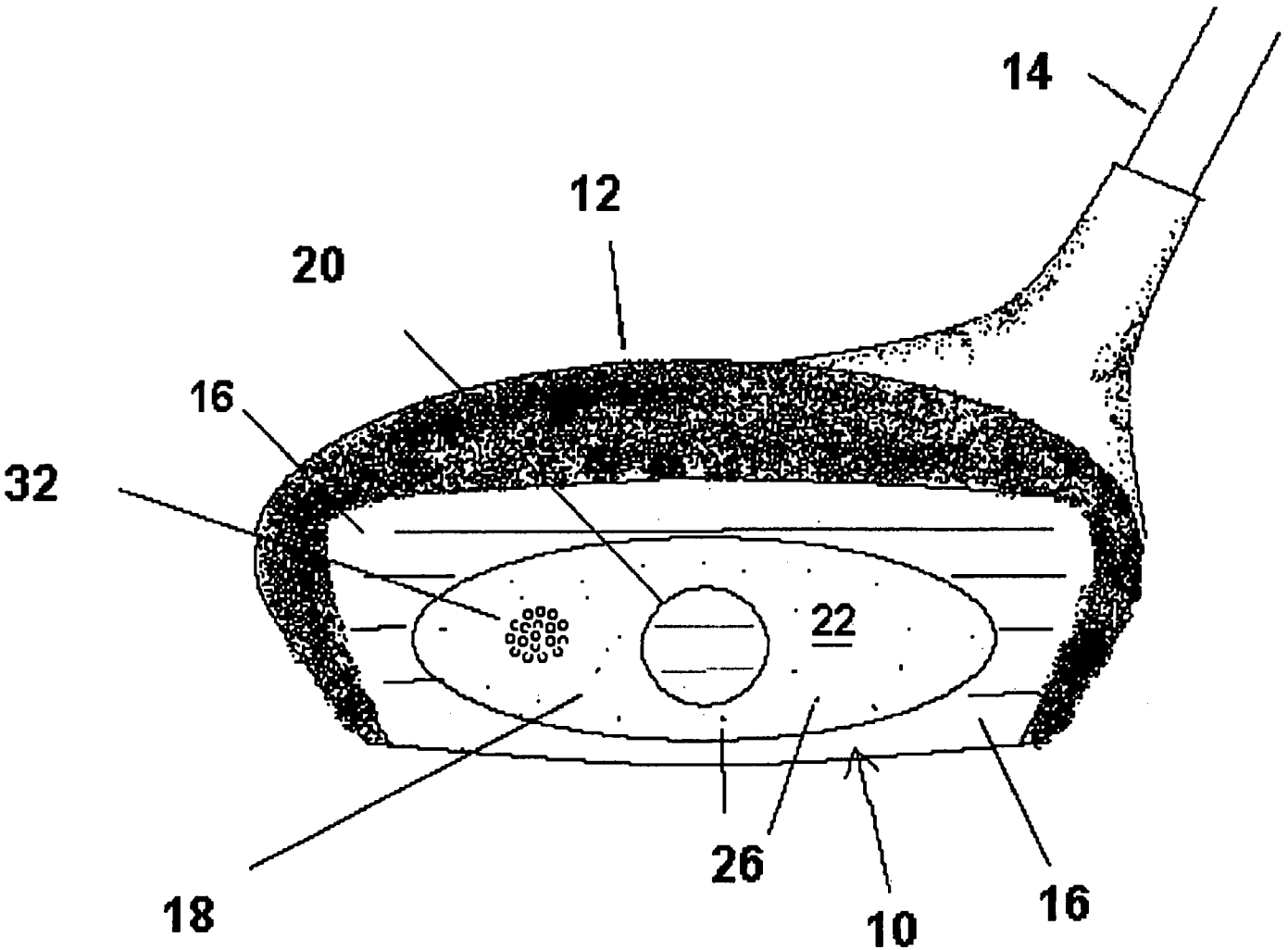
FIG. 2 is a front view of the recording device of FIG. 1 showing an image at the location of impact between a golf ball and the face of the golf club.
Figure 3:
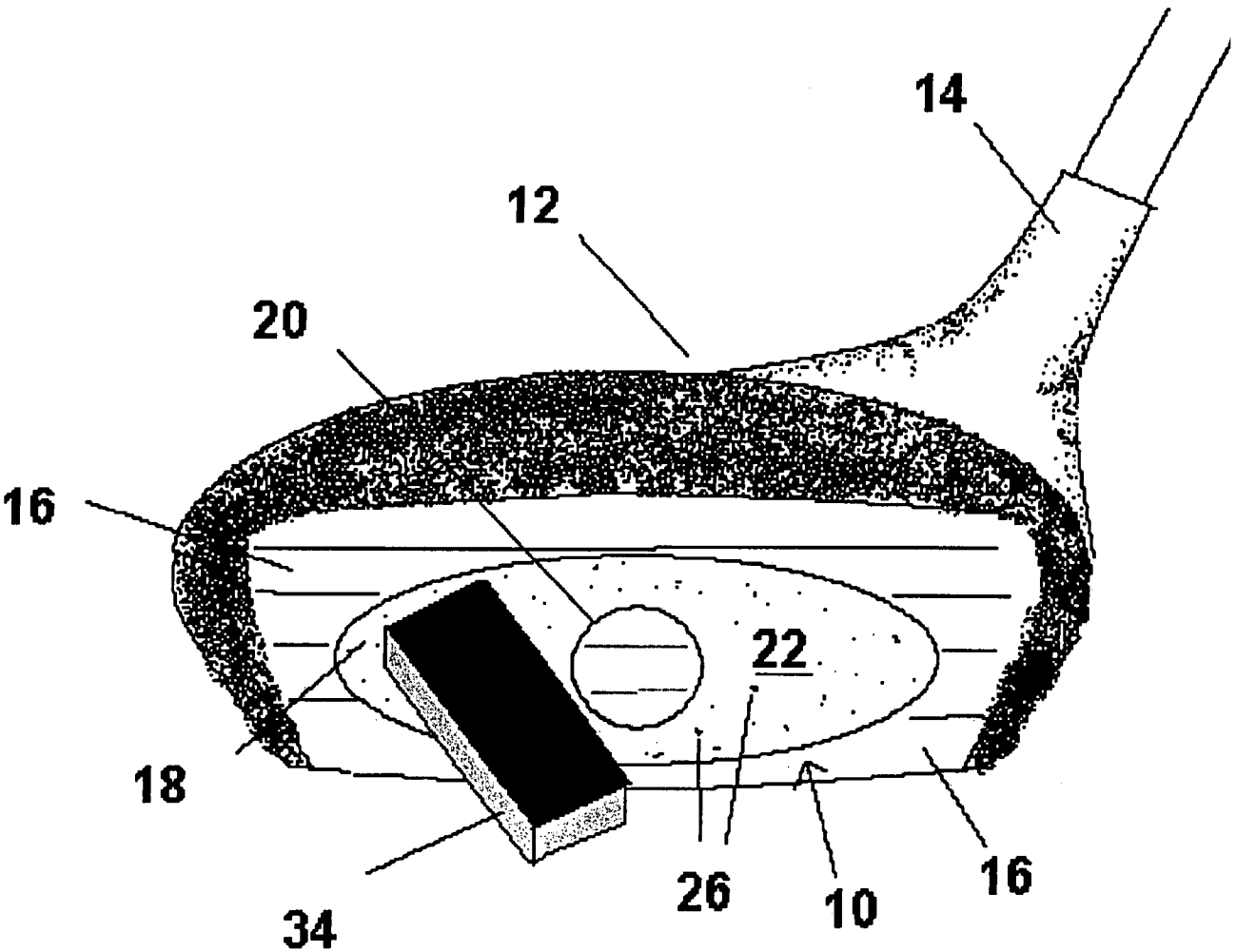
FIG. 3 is a front view of the recording device of FIG. 2 having the image at the impact location erased using a brushing device according to another embodiment of the present invention.

The method for using the present invention to record the impact location of a standard or regulation golf ball with the face of a golf club will now be described in detail (see FIGS. 2 and 3). To begin with, the golfer removes the backing material 30 from recording device 10 and affixes recording device 10 to the face 16 of golf club 14 using the adhesive material 28. If recording member 10 does not include an adhesive material on its back side, the golfer simply applies adhesive material to the back side 24 of recording member 18 prior to application of recording device 10 on the face of golf club 14.

If a central aperture 20 is provided on recording device 10, the central aperture is centered over the approximate sweet spot of the golf club. The sweet spot will generally be located in the center of the face of the golf club. Properly mounted and affixed, the back side 24 of recording member 18 is facing the face 16 of golf club 14 and the front napped recording surface 22 is facing away from face 16 of golf club 14.

With recording device 10 affixed to golf club 14, the golfer now brushes, sweeps or strokes napped recording surface 22 to raise the nap on the entire surface 22 of recording member 18. If a clear protective layer 36 is provided over recording member 18, the golfer must first lift or remove the protective layer before brushing the napped surface. After the nap on napped surface 22 has been raised, the clear protective layer, if present, is replaced over recording member 18. Recording device 10 is now setup to record the impact location of the golf ball with face 16 of golf club 14.

The golfer now takes a practice swing. Upon impact with the face of the golf club, a mark or impression 32 (see FIG. 2) is recorded on napped surface 22 of recording device 10 by the golf ball. In some cases, as previously mentioned, the mark or impression is so detailed that it actually takes the form of an image of the golf ball. In other words, the dimples of the golf ball are actually visible in the recording surface.

Immediately after impacting the recording member, the golf ball leaves the face of the golf club and assumes a certain trajectory, distance and direction of flight, each of which are dependent on the forces exerted on the golf ball by the golf club. The golfer can now view the location of mark 32 on recording device 10 to determine where on the face of the golf club the golf ball impacted the golf club. This information, combined with the observed direction of flight, distance and trajectory of the golf ball, may provide useful information to the golfer that will enable the golfer to adjust his or her stance, grip and/or swing to improve his or her golf shot.

It should be noted that practice devices that only utilize lightweight practice golf balls or that require that the golf ball stick to the face of the golf club in order to determine the impact location, do not provide the same amount of information to the golfer as the present invention because they do not provide trajectory, distance and/or direction of fight information to the golfer. To the contrary, they only provide the golfer with information regarding where on the face of the golf club the ball made contact.

This information alone, however, without information regarding the trajectory, distance and/or direction of fight of the golf ball, does not allow the golfer to determine exactly where on the face of the golf club the golf ball should be hit, only where it actually was hit. In other words, the golfer has no way of knowing if indeed the golf ball contacted the golf club at the sweet spot because the golfer does not know how a real golf ball would have behaved.

The mark 32 made by the golf ball on napped surface 22 of recording device 10 will generally remain on the napped surface until erased (e.g., it is erasibly recorded on the recording surface). Therefore, before taking another golf swing, the golfer may elect to erase the previous mark from recording member 18. This is accomplished in one embodiment by simply brushing napped surface 22 with a brush 34 (see FIG. 3) to raise the nap at the location of impact. Raising the nap at the location of impact erases mark 32 from recording device 10. Recording device 10 is now ready to be used for recording the next location of impact during the next golf shot.

Alternatively, if the golfer so desires, he can leave the previous mark 32 on recording member 18 and take one or more additional shots. Eventually, however, as napped surface 22 fills up with marks, it will be desirable for the golfer to brush the napped surface to remove all marks left by the golf balls. The golfer can decide whether he or she wants to do this after each golf shot or only after several golf shots have been made.

If at some point during the practice session, the golfer decides to practice with a different golf club, the golfer can remove recording device 10 from the face of the first golf club and affix it to the face of the new golf club. Alternatively, if the practice session is complete, the golfer can simply remove recording device 10 from the face of the first golf club and re-affix it to backing material 30 for use on another day. In this way, recording device 10 can be reused numerous times until the releasable adhesive degrades to the point where it can no longer be used to properly affix recording member 10 to the face of a golf club. At this point, a new recording member may be used. Alternatively, if recording member 18 is still usable, the golfer may decide to simply apply new adhesive to the back side 24 of recording member 18 and continue to re-use it until recording member 18 itself wears out.

Numerous modifications may be made to the present invention which still fall within the intended scope hereof. Thus, it should be apparent that there has been provided in accordance with the present invention an apparatus and method of recording the impact location of a golf ball upon a golf club that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An apparatus for recording an impact location between a golf ball and a solid face of a golf club comprising:

a leather recording member sized-to-fit on the solid face of the golf club, wherein the leather recording member includes a first side and a second side opposite the first side;

an adhesive layer disposed on the first side of the leather recording member for removably affixing the leather recording member to the solid face of the golf club; and a napped surface disposed on the second side of the leather recording member, wherein the napped surface is configured to record the impact location between the golf ball and the solid face of the golf club as an erasable mark in the napped surface.

2. The apparatus of claim 1 further including a barrier layer disposed between the adhesive layer and the first side of the leather recording member, wherein the barrier layer is disposed to impede the flow of oil from the leather recording member to the adhesive layer.

3. The apparatus of claim 2 wherein the barrier layer is a layer of polyurethane resin.

4. The apparatus of claim 2 wherein the barrier layer is a layer of nitro cellulose lacquer.

5. The apparatus of claim 1 wherein the leather recording member has a thickness in the range of 0.4 millimeters to 0.9 millimeters.

6. The apparatus of claim 1 wherein the leather recording member has an oil content in the range of 8 percent to 12 percent on the weight of the leather.

7. An apparatus for recording an impact location between a golf ball and a face of a golf club comprising:

a leather recording member sized-to-fit on the face of the golf club, wherein the leather recording member includes a first side and a second side opposite the first side;

an adhesive layer disposed on the first side of the leather recording member to affix the leather recording member to the face of the golf club;

a barrier layer disposed between the adhesive layer and the first side of the leather recording member, wherein the barrier layer is configured to inhibit the migration of oil from the leather recording member to the adhesive layer; and a napped surface disposed on the second side of the leather recording member, wherein the napped surface is configured to record the impact location between the golf ball and the face of the golf club.

8. The apparatus of claim 7 wherein the barrier layer is a layer of polyurethane resin.

9. The apparatus of claim 7 wherein the barrier layer is a layer of nitro cellulose lacquer.

10. The apparatus of claim 7 wherein the leather recording member has a thickness in the range of 0.4 millimeters to 0.9 millimeters.

11. The apparatus of claim 7 wherein the leather recording member has a thickness of approximately 0.6 millimeters.

12. The apparatus of claim 10 wherein the leather recording member has an oil content in the range of 8 percent to 12 percent on the weight of the leather.

13. The apparatus of claim 10 wherein the leather recording member has an oil content of approximately 10 percent on the weight of the leather.

14. The apparatus of claim 7 wherein the leather recording member has an oil content in the range of 8 percent to 12 percent on the weight of the leather.

15. The apparatus of claim 7 wherein the leather recording member has an oil content of approximately 8 percent to approximately 12 percent on the weight of the leather.

16. The apparatus of claim 7 wherein the leather recording member has an oil content of approximately 10 percent on the weight of the leather.

17. An apparatus for recording an impact location between a golf ball and a face of a golf club comprising:

a leather recording member sized-to-fit on the face of the golf club, wherein the leather recording member includes a first side and a second side opposite the first side, and further wherein the leather recording member has a thickness in the range of 0.4 millimeters to 0.9 millimeters;

an adhesive layer disposed on the first side of the leather recording member to affix the leather recording member to the face of the golf club; and a napped surface disposed on the second side of the leather recording member, wherein the napped surface is configured to record the impact location between the golf ball and the face of the golf club.

18. The apparatus of claim 17 wherein the thickness of the leather recording member is approximately 0.6 millimeters.

19. The apparatus of claim 17 wherein the leather recording member has an oil content in the range of 8 percent to 12 percent on the weight of the leather.

20. The apparatus of claim 17 wherein the leather recording member has an oil content of approximately 10 percent on the weight of the leather.

21. The apparatus of claim 17 further including a barrier layer disposed between the adhesive layer and the first side of the leather recording member, wherein the barrier layer is disposed to impede the flow of oil from the leather recording member to the adhesive layer.

22. An apparatus for recording an impact location between a golf ball and a face of a golf club comprising:

a leather recording member sized-to-fit on the face of the golf club, wherein the leather recording member includes a first side and a second side opposite the first side, and further wherein the leather recording member has an oil content in the range of 8 percent to 12 percent on the weight of the leather;

an adhesive layer disposed on the first side of the leather recording member to affix the leather recording member to the face of the golf club; and a napped surface disposed on the second side of the leather recording member, wherein the napped surface is configured to record the impact location between the golf ball and the face of the golf club.

23. The apparatus of claim 22 wherein the leather recording member has an oil content of approximately 8 percent on the weight of the leather.

24. The apparatus of claim 22 wherein the leather recording member has an oil content of approximately 12 percent on the weight of the leather.

25. The apparatus of claim 22 further including a barrier layer disposed between the adhesive layer and the first side of the leather recording member, wherein the barrier layer is disposed to impede the flow of oil from the leather recording member to the adhesive layer.

* * * * *